United States Patent [19]

Ziegler

[11] Patent Number: 4,768,470

[45] Date of Patent: Sep. 6, 1988

[54] GAS COOLER FOR SYNTHESIS GAS

[75] Inventor: Georg Ziegler, Winterthur, Switzerland

[73] Assignee: Sulzer Brothers Limited, Winterthur, Switzerland

[21] Appl. No.: 68,895

[22] Filed: Jun. 30, 1987

[30] Foreign Application Priority Data

Jul. 2, 1986 [CH] Switzerland ..... 02661/86

[51] Int. Cl.[4] ..... F22D 1/00

[52] U.S. Cl. ..... 122/7 R; 48/67; 122/32

[58] Field of Search ..... 122/7 R, 6 A, 235 A, 122/32; 48/67, 77

[56] References Cited

U.S. PATENT DOCUMENTS

| | | | |
|---|---|---|---|
| 4,395,268 | 7/1983 | Zabelka | 122/7 R X |
| 4,513,694 | 4/1985 | Wiemer | 122/7 R |
| 4,535,727 | 8/1985 | Ziegler | 122/7 R X |

*Primary Examiner*—Edward G. Favors

*Attorney, Agent, or Firm*—Kenyon & Kenyon

[57] ABSTRACT

The gas cooler has a pair of coaxial flues for the cooling of a synthesis gas wherein the flues are resiliently mounted independently of each other. The gas flow connection at the top of the pressure vessel is sized to permit the inner flue to be lifted out of the vessel for cleaning and repair purposes. In addition, the outer flue can be constructed of interconnected wall elements which may also be disconnected for discrete removal through the top of the vessel for cleaning and repair purposes.

10 Claims, 1 Drawing Sheet

GAS COOLER FOR SYNTHESIS GAS

This invention relates to a gas cooler for gas. More particularly, this invention relates to a gas cooler for synthesis gas.

As is known, various types of coolers have been provided for the cooling of gas, and particularly, synthesis gas. For example, U.S. Pat. No. 4,377,132 describes a gas cooler for synthesis gas which is formed of a pair of coaxial gas flues disposed vertically in a pressure vessel. In this case, each flue is formed of wall tubes which are welded together in gas-tight manner to be flowed through by a cooling medium. In addition, a gas flow connection is provided at the top end of the cooler coaxially of the flues in order to deliver gas into the inner flue while a second gas flow connection is provided near the top end of the vessel for the exhaust of cooled gas from the outer flue. In each case, each flue has at least one inlet main for the delivery of a cooling medium into the wall tubes as well as at least one outlet main for exhausting the heated medium. In addition, the inner gas flue is secured to outer gas flue. While the described construction has substantial advantages thermodynamically, the cooler has a disadvantage with respect to soiling since the wall tubes are not readily accessible.

As is known, synthesis gas contains solid impurities. Further, such gas usually enters a gas cooler of the above type at a temperature of about 1500° C. and a pressure of approximately 40 bar while leaving the cooler, for example, at a temperature of approximately 700° C. As a result, the gas flues experience considerable corrosion. Further, because of soiling, substantial local temperature differences often occur with a resulting thermal stressing. This further causes a detrimental loading of the flues. As a result, frequent servicing and cleaning of such gas coolers becomes necessary. Further, substantial repair work is likely to be necessary from time-to-time.

Generally, in such gas cooler constructions, the inner flue is particularly at risk because this flue experiences the highest temperatures and synthesis gas acts on both sides of the inner flue.

Accordingly, it is an object of the invention to provide ready access to the gas flues of a gas cooler for cleaning and repair work.

It is another object of the invention to simplify the cleaning and repair of a gas cooler containing coaxial gas flues.

It is another object of the invention to reduce the costs of cleaning and repairing gas coolers for synthesis gas.

It is another object of the invention to provide a simple gas cooler construction which does not require a great increase in initial costs nor impairment of operation.

Briefly, the invention provides a gas cooler, for example, for synthesis gas, which is comprised of a pressure vessel, a pair of coaxial gas flues disposed vertically in the pressure vessel in spaced relation to each other, a gas flow connection at an upper end of the vessel defining an opening of a size for passage of at least the inner flue vertically therethrough and means for releaseably mounting the flues in the pressure vessel independently of each other.

Each gas flue includes a plurality of tubes which are secured together in gas tight manner, as is known, for conveying a cooling medium therethrough, at least one inlet main connected to the tubes to deliver a cooling medium thereto an at least one outlet main connected to the tubes to exhaust heated cooling medium therefrom.

In addition to the gas flow connection at the upper end of the vessel, a duct in concentrically disposed within the connection for delivering a flow of hot gas into the inner flue. A second gas flow connection also communicates with an interior of the outer flue for exhausting a flow of cooled gas therefrom.

The construction of gas cooler is such that the inner flue can be pushed vertically through the upper end of the outer flue and the gas flow connection at the upper end of the vessel. Thus, it is a simple matter for the inner flue to be withdrawn from the pressure vessel independently of the outer flue so that optimum access is provided to the inner flue as well as to the inside of the outer flue.

The outer flue may also be constructed of at least three releaseably connected vertical walls which are dimensioned for individual vertical passage through the gas flow connection at the top of the pressure vessel. In this case, each vertical wall includes a plurality of tubes, a common inlet main connected to the tubes and a common outlet main connected to the tubes. This construction permits complete accessibility of the outer flue by the lifting out of the individual discrete walls from the pressure vessel.

As a matter of practicality, the inner flue and the discrete parts of outer flue can be constructed so as to each weigh approximately 25 tons, that is, a weight which can be readily handled by lifting tackle which is usually associated with a gas cooler of this type.

One particular advantage of the gas cooler is that the sequence in which the flues are made accessible coincides with actual need. Specifically, the most heavily stressed inner flue which is therefore the flue needing cleaning and overhaul most frequently, it the most accessible. The inside of the outer flue which is the second most accessible follows in the sequence and the least stressed outside of the outer flue and the inside of the pressure vessel are the last to become accessible.

When the inner flue is withdrawn from the pressure vessel, the mains connected to the tubes of the inner flue are also removed. Hence, any pressure and sealing testing which becomes necessary can be performed outside the pressure vessel. Likewise, where the individual vertical walls of the outer flue are removed, the same type of testing can be performed.

Of note, the satisfactory thermodynamic and flow behavior of the gas cooler are uneffected by the construction which permits the independent mounting or suspension of the flues within the gas cooler.

These and other objects and advantages of the invention will become more apparent from the following detailed description taken in conjunction with the accompanying drawings wherein.

Figure 1:
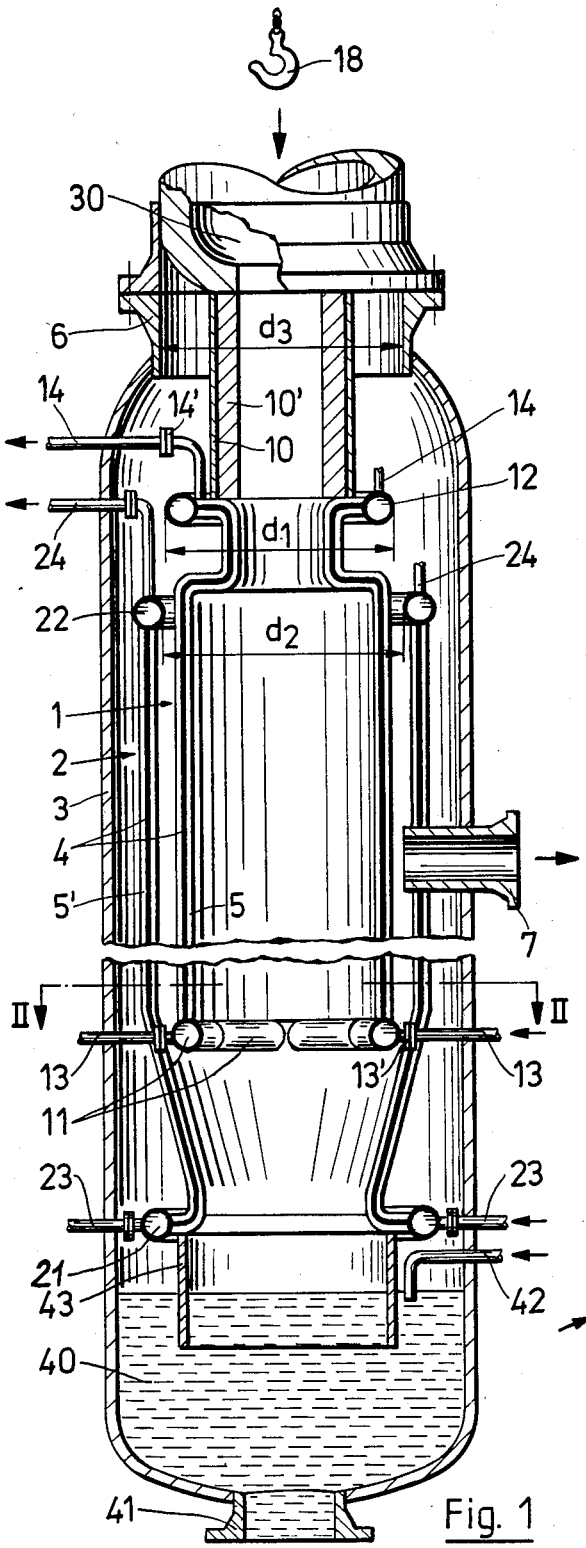
FIG. 1 illustrates a vertical diagrammatic longitudinal sectional view through a gas cooler constructed in accordance with the invention.

Referring to FIG. 1, the gas cooler is constructed for use in cooling a synthesis gas. This gas cooler includes a cylindrical vertical pressure vessel 3 in which a pair of coaxial gas flues 1, 2 are disposed vertically in spaced relation to each other. As indicated in FIG. 2, the flues 1, 2 are arranged coaxially and each is of prismatic shape.

Referring to FIG. 1, each flue 1, 2 is formed of a plurality of straight tubes 5, 5', respectively, which extend lengthwise of the flues and are secured together in gas-tight manner, for example by webs 4 which are welded thereto for conveying a cooling medium such as water or vapor therethrough.

The gas cooler also has a gas flow connection 6 at the upper end of the vessel 3 which is disposed to be coaxial of the flues 1, 2 and which defines an opening of a size or diameter 3D for passage of at least the inner flue 1 vertically therethrough. A second horizontal gas flow connection 7 is present in the top part of the vessel 3 and communicates with an interior of the outer flue 2 for exhausting a flow of cooled gas therefrom. As indicated, this connection 7 extends through the vessel 3 and the outer flue 2.

Figure 2:
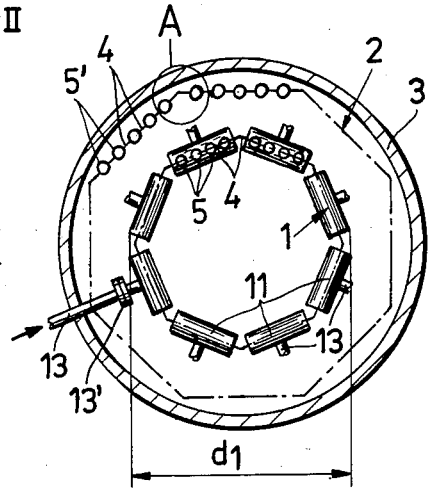
FIG. 2 illustrates a view taken on line II—II of FIG. 1.

As indicated in FIG. 2, each flue 1, 2 has a regular octagonal cross section bounded by eight walls which are offset by 22.5° from one another to leave the maximum possible cross-sectional area available for servicing in the gap between the two flues 1, 2.

As indicated in FIG. 1, the tubes 5 of each wall of the inner flue 1 extend at the bottom into an inner distrubutor such as an inlet main 11 which is supplied with a cooling medium such as water through a horizontal water line 13 extending through the pressure vessel 3 and outer flue 2. At the top end, each tube 5 of the inner flue 1 has a radially inwardly extending C-shaped bend which is adapted to take up distortion and which extends into an inner collector in the form of an outlet main 12 with one main 12 provided for each wall of the flue. Each main 12, in turn, connects to a steam line 14 which extends through the vessel 3 to a vapor or steam load (not shown).

The wall tubes 5' of the outer flue 2 form a funnel near the bottom end and extend radially outwardly along a horizontal plane to extend into eight outer distributors in the form of inlet mains 21, one for each wall. This shaping enables distortions to be taken up satisfactorily. As indicated, each inlet main 21 is supplied with a coolant such as water through a horizontally disposed water line 23 which extends through the pressure vessel 3. At the top ends, the tubes 5' extend into eight headers or outlet mains 22. Each outlet main is connected through a steam or vapor line 24 which extends through the pressure vessel 3 to a steam or vapor load (not shown) in the same manner as the inner mains 12.

Figure 3:
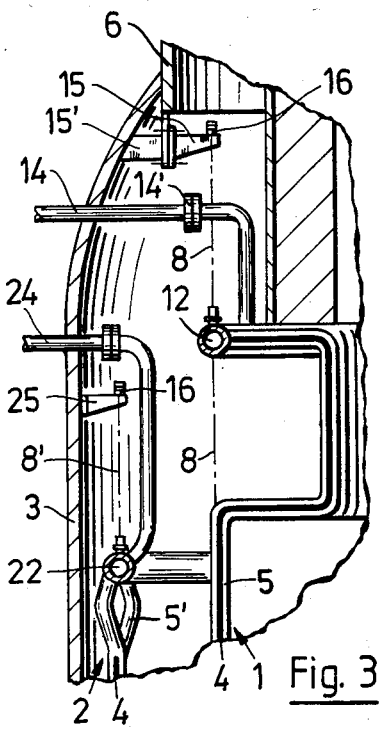
FIG. 3 illustrate a view of a detail at the top left-hand part of the cooler.

Referring to FIG. 3, means are provided for releaseably mounting or suspending the flues 1, 2 in the pressure vessel 3 independently of each other. As indicated, this means may be in the form of anchor bolts 8, 8' or other similar tension members. In addition, the inner flue bolts 8 are each secured to a releaseable carrying element 15 which, through the agency of horizontal screws (not shown) is connected to a bracket or the like 15' welded to the pressure vessel and to the gas flow connection 6. On the other hand, each outer flue bolt 8' is connected to a carrying element 25 which is welded directly to the pressure vessel wall. Still further, adjusting nuts 16 on the bolts 8, 8' provide a simple means of adjusting the bolts 8, 8' on the carrying elements 15, 25, respectively.

Referring to FIGS. 1 and 2, the inner flue 1 has a maximum horizontal dimension d1. In the case of the outer flue 2, the minimum horizontal dimension measurable inside the top part is the distance d2 between two parallel mains 22 (see FIG. 1). As indicated in FIG. 1, the dimension d3 of the gas flue connection 6 and the minimum horizontal distance d2 of the outer flue 2 are both greater than the maximum horizontal dimension d1 of the inner flue. Thus, the inner flue 1 can be readily lifted out the cooler, for example by means of a lifting tackle 18 shown symbolically in FIG. 1.

A gasification reactor 30 is releaseably secured by a flange connection to the gas flue connection 6. In addition, a gas carrying duct 10 is disposed concentrically within the gas flow connection 6 to extend coaxially from the inside of the reactor 30 into the inner flue 1 for delivering a flow of hot gas into the inner flue 1. In this way, the inside of the reactor 30 can be placed in permanent communication with the interior of the inner flue 1. In this respect, the duct 10 is highly heat resistant and provides thermal insulation. For example, the duct 10 is preferrably made of a thin steel tube which is lined with a thick layer 10' of insulation, for example in the form of a tamped composition or stamping mass.

As shown in FIG. 1, the bottom part of the pressure vessel 3 serves as a water bath 40 and communicates by way of a slag removal connection 41 with facilities (not shown) for treating heavily soiled hot water. Fresh water is supplied to the bath 40 through a water feed line 42 extending through the vessel 3. In addition, a vertical dip 43 is disposed coaxially on the flues 1, 2 and is preferrably carried by the outer flue 2 to extend into water bath 40.

Figure 4:
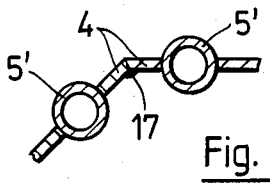
FIG. 4 illustrates a view to a larger scale than FIG. 2 of a detail A therein.

Referring to FIG. 4, the vertical walls of the outer flue 2 are releaseably connected to each other with the mains 21, 22 of each wall being rigidly connected to the tubes 5'. In this way, the outer flue 2 can be sub-divided at relatively low cost into eight discrete walls, each having a distributor 21 and collector 22 which can be lifted out from inside the vessel 3 through the gas flow connection 6. Since removal of these walls for maintenance and repair is required only on an exceptional base and then only rarely for all the walls simultaneously, the walls can be welded together by relatively thin relatively removable weld seams 17. Alternatively, screwed fastenings can be used instead of the weld seams 17.

During operation, hot synthesis gas flows from the reactor 30 through the duct 10 to the inside of the inner flue 1. The hot gas then flows downwardly through the flue 1 with heat radiating from the gas onto the wall tubes 5. After leaving the bottom of the inner flue 1, the synthesis gas is deflected upwardly into the inside of the outer flue 2 and flows between the two flues 1, 2 radiating heat to the inner flue tubes 5 as well as the outer flue tubes 5'. During flow, a substantial quantity of the impurities in the synthesis gas is deposited partly on the water bath 40 and partly on the surfaces of the flues 1, 2 from whence the impurities can drop into the water bath 40.

Feed water also flows through the water lines 13, 23 into the respective inlet mains 11, 21 and, preferrably by natural circulation through the wall tubes 5, 5' until reaching the outlet mains 12, 22 in the form of steam. The steam then passes into the steam lines 14, 24, respectively, to the respective loads.

The synthesis gas which has been cooled leaves the cooler through the gas outlet connection 7. The zone above this connection 7 between the inner flue 1 and the outer flue 2 and the pressure vessel 3 are full of stagnant synthesis gas so that the outer wall of the outer flue 2 removes heat therefrom. Some pressure equalization therefore occurs in the pressure vessel 3 between the inside and outside of each gas flue. Hence, the gas flues can be constructed for relatively low pressure differences and only the pressure vessel 3 experiences a high internal pressure.

From the above description of the operation of the gas cooler and in view of the heat insulation provided by the duct 10, it will be apparent that the entire suspension of the flues 1, 2, particularly, the bolts 8, 8' is disposed in a relatively cool zone of the cooler.

For cleaning and repairs, the reactor 30 and the duct 10 are removed so that the inner flue 1 is free to be lifted out of the pressure vessel 3. The flue 1 is then suspended on the lifting tackle 18, the releaseable elements 15 are disconnected and the connections to the water lines 13 (flange 13') and to the stream lines (flange 14') are released. The inner flue 1 can then be lifted out of the pressure vessel 3 through the connection 6 and conveyed to a work place. Both the flue 1 and the inside of the outer flue 2 are now readily accessible. Since the inlet mains 11 and outlet mains 12 can be transported with the remainder of the inner flue 1, these mains 11, 12 can be tested for pressure and seal-tightness before reassembly.

If it proves necessary to improve access to the outer flue 2 or a part thereof or to the inside of the pressure vessel 3, the outer flue 2 can be wholly or partly broken down into discrete walls after the weld seams 17 between the walls have been removed. The discrete walls can then be lifted out of the pressure vessels 3 by means of the lifting tackle 18 for conveyance to a work place. The mains 21, 22 taken with these discrete walls can also be subjected to pressure and seal tests before reassembly.

The gas cooler described above provides a practical embodiment because of its characteristic gas conveyance since this provides advantageous conditions for separation of the impurities present in the synthesis gas.

Of note, the releaseable carrying elements 15 can be eliminated and the bolts 8 of the inner gas flue 1 can be secured to carrying elements which are rigidly secured to the pressure vessel 3 so that each bolt 8 is inclined to the vertical axis. However, the vertical bolts 8 of the inner flue 1 not only considerably reduce mechanical stressing in the cooler but facilitate centering of the inner flue in a manner greatly simplifying fitting and removal of the inner flue. Further, the water lines 13, 23 and steam lines 14, 24 are adapted to reduce or inhibit any tendency of the gas flues 1, 2 to oscillate.

As illustrated in FIGS. 1 and 3, the tubes 5, 5' which are bent radially towards the inside of the flue in order to take up distortions, fulfill an important function since, for example, because of heat expansion and/or earthquake, relatively substantial distortions may occur which would cause sever damage if the flues were insufficiently resilient. In particular, the resilience ensures better take up of knocks and impacts during overhaul and assembly work.

If the gas cooler is constructed for relatively high exit temperatures from the exhaust gas flow connection 7, the top end of the gas between the flues 1, 2 can be closed by a releaseable cover with pressure equalization of the inside of the vessel 3 being achieved in some way. For example, pressure equalization can be obtained by connecting the interior of the vessel 3 to the cool part of a following gas cooler and by connecting this part via a cooling path to the synthesis gas entry. A restrictor or throttle element in the last-named connection interrupts the connection to the second gas cooler in normal operation.

Further, the releaseable carrying elements 15 can be secured releaseably to the inner flue 1 and the bolts 8 can be secured directly to the carrier 15' rigidly secured to the pressure vessel 3.

The invention thus provides a gas cooler of relatively simple construction which can be readily dismantled for repairs and cleaning of the flue surface. Further, the construction of the gas cooler is such as to not interfere with the normal operation of the gas cooler.

What is claimed is:

1. A gas cooler for synthesis gas comprising a pressure vessel;

a pair of coaxial gas flues disposed vertically in said pressure vessel in spaced relation to each other, each flue including a plurality of tubes secured together in gas tight manner for conveying a cooling medium therethrough, at least one inlet main connected to said tubes to deliver a cooling medium thereto and at least one outlet main connected to said tubes to exhaust heated cooling medium therefrom;

first gas flow connection at an upper end of said vessel defining an opening of a size for passage of at least an inner flue of said pair of flues vertically therethrough;

a duct concentrically within said first gas flow connection for delivering a flow of hot gas into said inner flue;

a second gas flow connection communicating with an interior of the outer flue of said pair of flues for exhausting a flow of cooled gas therefrom; and means for releaseably suspending said flues in said pressure vessel independently of each other.

2. A gas cooler as set forth in claim 1 wherein said outer flue includes at least three releaseably connected vertical walls dimensioned for individual vertical passage through said first gas flow connection.

3. A gas cooler as set forth in claim 2 wherein each wall includes a plurality of said tubes, a common inlet main connected to said latter tubes and a common outlet main connected to said latter tubes.

4. A gas cooler as set forth in claim 1 wherein said means includes at least one carrying element releaseably secured to said pressure vessel and at least one tension member secured to and between said inner flue and said carrying element.

5. A gas cooler as set forth in claim 1 wherein said pressure vessel is cylindrical and said flues are coaxial with said pressure vessel.

6. A gas cooler as set forth in claim 1 wherein said tubes of at least one flue are straight and have an inwardly radially bent section near at least one main to take-up distortions.

7. A gas cooler comprising a pressure vessel a pair of coaxial gas flues disposed vertically in said pressure vessel in spaced relation to each other, each flue including a plurality of tubes secured together in gas tight manner for conveying a cooling medium therethrough, at least one inlet main connected to said tubes to deliver a cooling medium thereto and at least one outlet main connected to said tubes to exhaust heated cooling medium therefrom;

a first gas flow connection at an upper end of said vessel defining an opening of a size for passage of at least an inner flue of said pair of flues vertically therethrough;

a duct within said gas flow connection for delivering a flow of hot gas into said inner flue; and means for releaseably mounting said flues in said pressure vessel independently of each other.

8. A gas cooler as set forth in claim 7 wherein said outer flue includes at least three releaseably connected vertical walls dimensioned for individual vertical passage through said first gas glow connection.

9. A gas cooler as set forth in claim 7 wherein said means includes at least one carrying element releaseably secured to said pressure vessel and at least one tension member secured to and between said inner flue and said carrying element.

10. A gas cooler as set forth in claim 9 wherein said pressure vessel is cylindrical and said flues are coaxial with said pressure vessel.

* * * * *

UNITED STATES PATENT AND TRADEMARK OFFICE

CERTIFICATE OF CORRECTION

PATENT NO. : 4,768,470

DATED : September 6, 1988

INVENTOR(S) : GEORGE ZIEGLER

It is certified that error appears in the above-identified patent and that said Letters Patent is hereby corrected as shown below:

Column 2, line 3 change "an" to -and-

Column 2, line 6 change "in" to -is-

Column 2, line 51 change "uneffected" to -unaffected-

Column 3, line 15 change "3D" to -D3-

Column 4, line 42 change "on" to -in-

Column 4, line 42 change "base" to -case-

Column 4, line 61 change "preferrably" to -preferably-

Column 5, line 64 change "gas" to -gap-

Column 6, line 28 change "first" to -a first-

Column 8, line 2 change "glow" to -flow-

Signed and Sealed this

Fourteenth Day of February, 1989

*Attest:*

DONALD J. QUIGG

*Attesting Officer*

*Commissioner of Patents and Trademarks*